United States Patent [19]

Hillberg

[11] 4,424,638

[45] Jan. 10, 1984

[54] HANDGUN

[75] Inventor: Robert L. Hillberg, Cheshire, Conn.

[73] Assignee: COP, Inc., Torrance, Calif.

[21] Appl. No.: 388,934

[22] Filed: Jun. 16, 1982

Related U.S. Application Data

[63] Continuation of Ser. No. 111,870, Jan. 14, 1980, abandoned.

[51] Int. Cl.[3] ..... F41C 19/14; F41C 19/00

[52] U.S. Cl. ..... 42/69 R

[58] Field of Search ..... 42/69 R, 69 B, 65, 41, 42/42 R, 42 B, 8

[56] References Cited

U.S. PATENT DOCUMENTS

| | | | |
|---|---|---|---|
| 644,402 | 2/1900 | Bye | 42/69 R |
| 756,039 | 3/1904 | Mossberg | 42/69 R |
| 1,070,145 | 8/1913 | Lewis | 42/69 R |
| 1,348,035 | 7/1920 | Mossberg | 42/8 |
| 1,637,079 | 7/1927 | Karner, Jr. | 42/69 R |
| 3,352,046 | 11/1967 | Warner et al. | 42/69 R |
| 3,548,530 | 12/1970 | Rohm | 42/69 R |

FOREIGN PATENT DOCUMENTS

| | | | |
|---|---|---|---|
| 1556769 | 12/1968 | France | 42/69 R |

*Primary Examiner*—Charles T. Jordan

*Attorney, Agent, or Firm*—McCormick, Paulding & Huber

[57] ABSTRACT

A new and improved handgun providing a strut assembly which engages the hammer assembly at two contact points, one of which is at the hammer pivot point which acts as a stop. An improved sequential firing mechanism is disclosed making use of notches on a ratchet engaged by a detent to secure proper alignment and positioning of the hammer firing mechanism with the firing pin. The invention also provides a safety mechanism for preventing the accidental firing of additional shots in a multibarrel handgun.

18 Claims, 6 Drawing Figures

HANDGUN

This application is a continuation, of application Ser. No. 111,870, filed Jan. 14, 1980, now abandoned.

BACKGROUND OF THE INVENTION

This invention relates to firearms. More specifically, this invention relates to handguns capable of firing high-powered ammunition.

Conventional handguns have employed a rebound assembly comprising a strut which engages the hammer after firing and returns the hammer to the at-rest or safety position. The struts have generally employed a bifurcated engaging means whereby an engagement is made at two contact points generally symmetrical to the pivot point of the hammer pin and the hammer is "rocked" into a safety position. This type of rebound cam assembly is exemplified in U.S. Pat. No. 3,988,849.

Additionally, prior multibarrel handguns have provided means for sequentially firing the barrels. This sequential firing has been frequently accomplished in part by means of mounting a firing element on a ratchet, which rotates on the hammer so as to sequentially align with the firing pins during firing.

Unfortunately, multibarrel handguns employing sequential firing mechanisms have exhibited firing malfunctions, such as a machine gunning effect whereby one pull of the trigger results in a rapid sequential firing of all of the barrels of the firearm. The result of this rapid sequential fire is exacerbated with high-power ammunition and frequently results in violent recoil forces often endangering the firearm user and severely affecting the accuracy and effectiveness of the handgun.

SUMMARY OF THE INVENTION

This invention provides a new and improved strut assembly means whereby the strut is forceably engaged with the hammer assembly at only one point prior to firing and the hammer assembly is permitted to return to the at-reset or safety position when the strut is stopped against the hammer pivot. This feature considerably reduces the chances of misfire, since the conventional rocking engagement of the cam strut frequently compresses the strut spring on the rebound resulting in a diminished forward hammer thrust. The diminished forward thrust can result in a misfire. Additionally, the improved strut assembly permits the attainment of a neutal positioning of the hammer after firing.

This invention further provides a new and improved method for indexing and rotating the ratchet on a multibarrel firearm in part by employing notches on a ratchet both to facilitate the rotation of the ratchet and to position the firing lug on the ratchet in alignment with an associated cartridge chamber. This improvement allows for easier alignment during assembly process, makes the operation of the firearm more efficient during the firing process and reduces the manufacturing expense, since fewer assembly elements are necessary.

This invention further provides for a new and improved mechanism which acts to eliminate machine gunning by means of an outwardly projecting lug on the trigger assembly. The lug prevents the pawl or hand which rotates the ratchet and hence the firing plate, from rotating the firing lug to a new position so as to align with a chamber containing an unfired cartridge until the trigger has been fully returned to the safety or at-rest position.

An object of the invention is to provide a new and improved means for aligning the firing lug with the firing pins or cartridge chambers in a multibarrel handgun.

Another object of the invention is to provide a new and improved means of sequentially firing a multibarrel handgun.

A further object of the invention is to provide a mechanism for preventing the machine gunning effect upon initial firing of the handgun.

A still further object of the invention is to provide certain improvements in the form, construction and arrangement of the several parts whereby the above-named and other objects may effectively be attained.

The invention accordingly comprises the features of construction, combinations of elements, and arrangement of parts which will be exemplified in the constructions hereinafter set forth, and the scope of the invention will be indicated in the claims.

BRIEF DESCRIPTION OF THE DRAWINGS

FIG. 6 is a detailed view similar to FIG. 2 showing the hammer and trigger in cocked position, parts being broken away.

DESCRIPTION OF THE PREFERRED EMBODIMENT

Figures 1, 2:
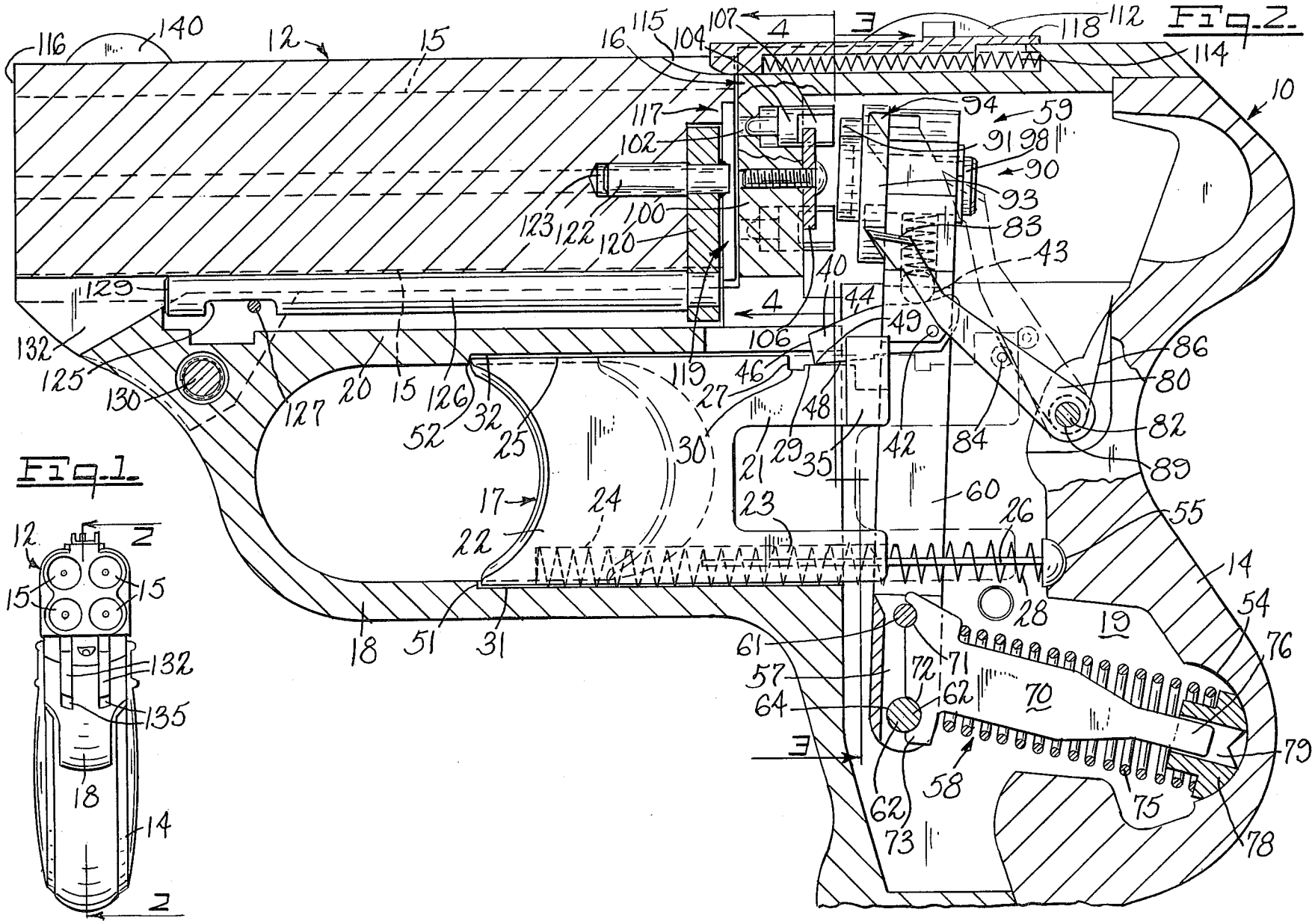
FIG. 1 is a front elevational view of a four-barrel handgun.
FIG. 2 is a vertical sectional view along the lines 2—2 of FIG. 1 showing the gun in an at-rest position, parts being broken away.

Referring to the drawings, the handgun has a frame 10 which includes the grip portion 14, the breech portion 16, the barrel portion 12, trigger guard 18 and the barrel mounting portion 20. The frame 10 is centrally recessed as indicated at 19 to receive the trigger assembly 17, hammer assembly 59 and the strut assembly 58. A pair of mounting slots 135, which open outwardly and upwardly from the barrel mounting portion 20, receive a pair of mounting tongues 132 of the barrel assembly 12.

The barrel assembly 12 consists of four cylindrical barrels 15 extending the length of the assembly from an exit end 116 to a cartridge chamber at the cartridge receiving end 117, said barrels being arranged in pairs side by side, with one pair being mounted on top of the other. The barrel assembly 12 is mounted on the pair of mounting tongues 132, which are pivoted on a barrel pivot pin 130 inserted through the barrel mounting portion 20 and mounting slots 135. A front sight 140 is mounted at the top of the exit end 116 of the barrel assembly. A release groove 115 is formed in the top of the barrel assembly at the cartridge receiving end 117. Said release groove is adapted to receive a latch plate 118.

An extractor bore 123 which is parallel to the barrels 15 and centrally positioned with respect to said barrels 15 opens rearwardly to a central recess 119 in the cartridge receiving end 117. The extractor bore 123 slidably receives an extractor guide 122, orthogonally connected to an extractor plate 120, so that the guide 122 and plate 120 may be received in the central recess in general alignment with the barrels and cartridge chambers at the cartridge receiving end 117. The vertical extractor plate 120 extends below the barrels 15 to connect to a horizontally disposed extractor push rod 126. The extractor push rod 126 is slidably retained on the barrel assembly by means of a guide pin 127, which supports the extractor push rod 126 between the mounting tongues 132. The extractor push rod 126 is provided with a recess 125 to receive the pin 127, the horizontal dimensions of said recess 125 defining the limits of the sliding of the push rod 126, and hence the movement of the extractor plate with respect to the barrel assembly. As the barrel assembly 12 is pivoted from its closed position to an open position, the end of the barrel mounting portion 20 contacts with the push rod end 129 imparting a sliding movement to the extractor 126, and causing the extractor plate 120 to move rearwardly with respect to the barrels at the cartridge receiving end 117, thus facilitating the removal of spent cartridges from the cartridge chambers.

In a closed position, the cartridge receiving end 117 is adjacent the breech portion 16. The barrel assembly is secured in a closed position by the engagement of the latch plate 118 in the release groove 115 of the barrel assembly. The latch plate 118 is biased toward a forward position by means of a spring 114. The barrel assembly is opened by forcing a latch release 112 toward the rear of the frame, thus removing the latch plate from the release groove 115 and allowing the barrel assembly 12 to be pivoted to an open position.

A trigger 22 is slidably mounted at its top in a mounting groove 32 and at its bottom in a trigger guard groove 31, said grooves being horizontally disposed. At the rear, the trigger 22 has a bifurcated end consisting of an upper segment 21 and a lower segment 23. A trigger groove 24 formed in the bottom of the trigger 22 extends through the bottom of the lower segment 23 and is adapted to receive a trigger spring 28. The trigger spring 28 is mounted on one end around a trigger spring guide rod 26, which is held in a rod recess 55 of the frame 10 by the force of the spring. The other end of the trigger spring 28 extends into the trigger groove 24, so as to urge the trigger toward the front of the handgun. The forward movement of the trigger is limited by the trigger groove end 51 and the mounting groove end 52. Thus, the trigger is supported in the frame for movement between a ready position, shown in full lines in FIG. 2, and a firing position shown in FIG. 6.

The upper edge of the rear segment 21 of the trigger is recessed to form a bottom surface 29 having at its forward end a notch 30 and a rearwardly facing end wall 27 adjacent to a trigger top surface 25. An outwardly projecting lug 35 is mounted on the side near the rear end of the upper segment 21 of the trigger.

The hammer assembly 59 comprises a hammer 60 pivotally mounted at its lower end on a hammer pivot pin 62, extending through each side of the frame 10 and through a pivot bore 64 in the hammer. Near the top of the hammer 60 a horizontally disposed hammer bore 65 extends from the percussion side to the back side of the hammer 60. A sear plunger bore 67 opens upward into the hammer bore 65. The sear plunger bore 67 is adapted to receive a sear plunger 43 in the form of a ball, which is received beneath a sear plunger spring 45, so that the sear plunger 43 is urged in a downward direction.

A detent bore 96, parallel to the hammer bore 65, opens outward on the percussion side of the hammer. The detent bore is adapted to receive a ball detent mechanism which includes a spring 97 and a detent 99 in the form of a ball urged by the spring in an outward direction toward the front of the handgun.

The firing element or ratchet 90 comprises a disc 93 integral with a hub 98, which is rotatable in the hammer bore 65. Opposite the hub 98, the circular ratchet rim 92 has on its outer circumference a radially projecting firing lug 91.

The ratchet, and in particular the firing lug 91, is adapted to make contact with firing pins 104 in a breech block 100 hereinafter described. The outside diameter of the ratchet rim is generally commensurate with the diameter of the firing pin retainer washer 106, hereinafter described. The inside diameter of said rim is greater than the diameter of the head of retaining pin 108, hereinafter described, and the height of said rim is greater than the longitudinal dimension of the head of pin 108.

Four symmetrically spaced notches 94 around the circumference of the ratchet disc face toward the hub side of the ratchet. The ratchet is mounted on the hammer 60 by inserting the ratchet hub 98 through the hammer bore 65 and securing the end of the hub by means of a retaining ring 95, so that the ratchet rim faces toward the front of the handgun. The notches are in circumferential positions to receive the ratchet plunger as it is urged forward, and the ratchet is in general alignment with the breech block 100 when the hammer is in the at-rest position as shown in FIG. 2.

Below the sear plunger 43, a sear recess 41 opens downward and extends through both the percussion side and the back side of the hammer. The sear 40 is received in the sear recess 41 and pivotally connected to the hammer by means of a sear pivot pin 42. The sear 40 extends through the concussion side and is disposed in a generally horizontal position. The sear 40 has an upper sear cam surface 44 and a bottom surface 48 adjacent to a sear end surface 46. The sear is urged downward by means of the sear plunger 43 being forced against the sear cam surface 44. In the at-rest position, as shown in FIG. 2, a sear edge 49 which is at the intersection of the sear end surface 46 and the sear bottom surface 48, rests on the trigger recess bottom 29.

A strut slot 57 formed in the bottom of the hammer 60 opens outwardly through the back side, so as to receive a hammer strut 70. The hammer strut 70 comprises a generally "T" shaped a yoke 73 on one end and a strut retaining end 76 at the other end. The front of the yoke contains a strut seat 71 and a stop seat 72, the seat 71 being forced against a pin 61 located on the hammer above and parallel to the hammer pivot pin 62 by the strut spring 75. The rear end of said strut spring 75 is fitted on a base 78, in a recess 54 in the rear portion of the frame 10. The strut extends through the central axis of the spring 75 with the end 76 being retained in the recess 79 in the base, so that the bias of the spring 75 urges the strut 70 in a forward direction, with the seat and 72 biasing against the pin 62 when the triger and hammer are in an at-rest position, as shown in FIG. 2.

An indexing pawl or hand 80 is pivotally connected to the frame 10 by a pivot pin 82 and is urged in a forward direction by a torsion spring 86 mounted on the pivot pin 82 so that one end of the spring bears against a spring retainer 84 and the other end against the interior of the frame, thus urging the pawl or hand in a forward direction. The free end of the pawl is adapted to engage in the notch 94 when the hammer and trigger are in an at-rest position, as shown in FIG. 2.

The breech block 100 vertically disposed between the barrel assembly 12 and the central recess 19 is in general horizontal alignment with the ratchet 90. Four horizontal symmetrically placed stepped concentric bores 102 in the breech block are axially aligned with the centers of the respective barrels 15 at the cartridge receiving end 117 when the barrel assembly 12 is in the closed position.

Figures 3, 4, 5:
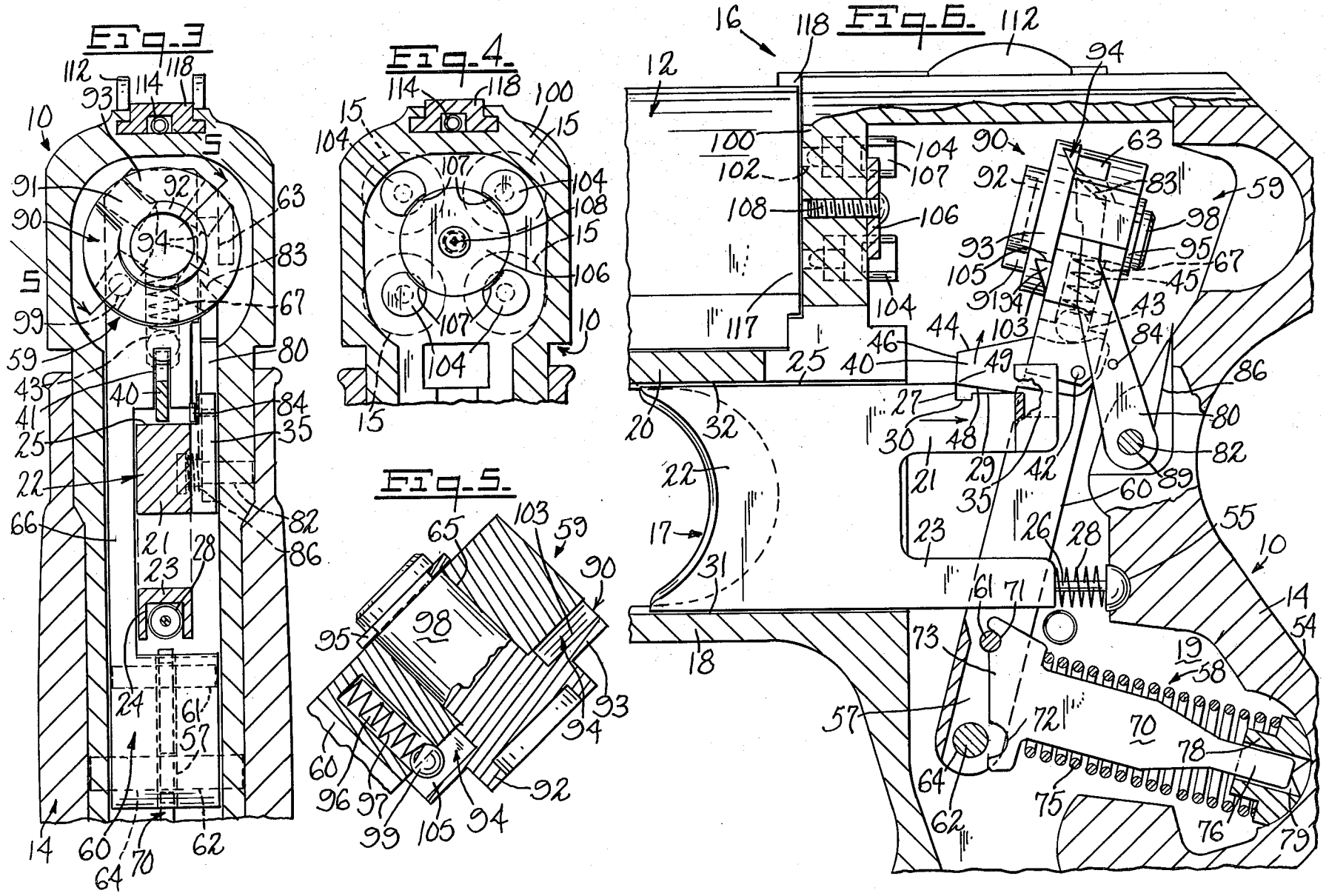
FIG. 3 is a vertical sectional view along the line 3—3 of FIG. 2 looking toward the rear of the handgun.
FIG. 4 is a detailed vertical sectional view along the line 4—4 of FIG. 2 looking toward the front of the handgun.
FIG. 5 is a detailed sectional view of the ratchet and part of the hammer assembly along the line 5—5 of FIG. 3.

A firing pin 104 is received in each of the firing pin bores 102. The head of each firing pin is cut away at 107 so that the firing pins may be secured in the breech block by means of a firing pin retaining washer 106, which is fastened to the breech block by a threaded retaining pin 108, as shown in FIGS. 4 and 6. The firing pin/retaining washer configuration allows for a small degree of movement of the firing pin 104 in the firing pin bore 102. The firing pins are in general alignment with the ratchet 90 when the hammer is in a firing position, which position is not shown in the drawings.

During firing, the firing lug 91 on the ratchet makes contact with one of the four firing pins 104. The ratchet may be suitably rotated so that the firing lug is in successive sequential alignment with each of the firing pins 104. It may thus be seen that it is necessary that the firing plate 91 be positioned in one of four circumferential positions on the ratchet, so as to obtain required alignment between the firing lug 91 and each firing pin 104.

The rotation and incremental positioning of the ratchet is accomplished by means of the unique utilization of the notches 94 to both facilitate rotation and secure correct positioning. The ratchet plunger, situated in the hammer shaft, forces a plunger ball into one of the four notches 94 circumferentially arranged around the ratchet. The plunger 99 will engage each of the notches upon rotation of the notch to a position in the vicinity of the plunger bore 96, thus securing the firing lug 91 at one of four positions or striking locations, each of which will be in alignment with a corresponding firing pin 104 of the breech block 100. The seating of the plunger in the bottom of each notch effects fine adjustment of the ratchet in each of the four operative positions.

Each notch 94 is defined by a slant surface 103 which is inclined outwardly and away from a surface 105 which is perpendicular to the face of the disc 93 and extends radially outward. When a notch is aligned with the plunger 99, the plunger is forced into the notch. Because of the relatively lower resistance to disengagement by the slant surface 103 as opposed to the surface 105, rotational movement of the ratchet is unidirectional. In operation, the barrel assembly 12 is moved to an open position by forcing the latch release 112 toward the rear of the gun and pivoting the barrel assembly on the barrel pivot pin 103. Cartridges are placed in each of the cartridge chambers at the cartridge-receiving end 117 of the barrel assembly. The barrel assembly is then pivoted back to a generally horizontal position and the latch plate 118 is secured in the release groove 115.

The hammer strut 70 does not exert biasing force upon the hammer 60 when the gun is at rest, as shown in FIG. 2. The hammer is supported for limited pivotal movement about the axis of the pin 62 and generally toward and away from the breech block free of the influence of the hammer strut 70 and the strut spring 75, as it appears in FIG. 2. Thus, the firing pins are slidably movable within the breech block free of influence of the strut assembly 58. However, the pawl 80 which is biased toward the striking position and into engagement with the firing element 90 by the spring 94, acts through the firing element to bias the hammer toward its striking position when the trigger is in its ready position and during initial movement of the hammer toward its releasing position in response to movement of the trigger toward its firing position. This arrangement allows any firing pin which may project beyond the face of the breech block to be freely cammed rearwardly within the breech block and to a position flush with the breech block face when the barrel assembly is pivoted to and latched in its closed position.

The handgun is fired by drawing the trigger 22 toward the rear of the handgun from an at-rest position to its firing position as exemplified in FIG. 2 past a cocked position, which is exemplified in FIG. 6. The forcing of the trigger toward the rear of the handgun results in a relative position change in the hammer 60, the strut 70, the sear 40, the pawl 80 and the ratchet 90, all of which act in a coordinated movement so as to fire the handgun.

In the at-rest position shown in FIG. 2, the sear edge 49 rests on the bottom 29 of the trigger recess. As the trigger slides rearward, the sear edge 49 slides into the recessed notch 30 of the trigger. Further movement of the trigger results in contact between the sear end 46 and the recess end 27. The sear plunger 43 urges the sear 40 downward thus securing a firm engagement of the sear end 46 and the sear edge 49 with the recess edge 27 and the recess notch 30. Further movement of the trigger exerts a rearward force on the hammer 60, which is pivotally engaged to the frame by the pivot pin 62 resulting in a rearward pivot of the hammer toward the back of the frame to its releasing position.

As the hammer pivots around the pivot pin 62, the stop seat 72 loses contact with the pivot pin 62 while contact remains with the strut seat 71 and the pin 61, as shown in FIG. 6. The strut spring 75 is further compressed, and the strut retaining end 76 is forced further into the recess 79.

In the at-rest position of FIG. 2, the pawl 80 is engaged in the notch 94 near the bottom of the ratchet, the pawl being biased in a forward direction. As the hammer pivots, the notch surface 83 of the pawl is forced against the surface 105 of a lower notch 94. Further pivoting of the hammer results in the pawl 80 being forced in an upward direction with respect to the hammer and the ratchet thus imparting a rotational movement to the ratchet. The path of the pawl-engaging surface travels upward through a pawl slot 63 extending through the top of the hammer so that the slot is aligned with an upper-fixed position of a notch. At the top of the path, the surface 105 is parallel and adjacent the sides of slot 63 so that the pawl no longer engages the surface in an oblique upward type of contact, but slides upwardly along the surface 105, thus terminating the rotational force created by the notch-engaging surface 83 on the pawl-receiving surface of the notch 94. Upon termination of rotation, the ratchet plunger 99 engages a notch 94 and holds the ratchet in a new fixed position. The end of the pawl or hand is now biased to slide down and engage the next lower notch at such time as the hammer resumes a forward pivot position.

The pivoting of the hammer also results in a relative change in position of the sear 40 with respect to the trigger 22. Being pivotally connected to the hammer 60 the sear 40, upon rearward pivot of the hammer, will eventually assume a position in which the sear bottom 48 is generally lower than that of the trigger recess bottom 29. Thus, the sear bottom 48 will ride up and come into contact with the recess bottom 29, and the position of the sear edge 49 will rise relative to the recess end 27. Further movement of the trigger will result in a position where the sear edge 49 will clear the top of the recess end 27 and will thus slide along the trigger top surface 25, so that the sear bottom 48 rests on the top surface 25. At this point, the force acting to pivot the hammer toward the rear, which force is exerted on the hammer 60 by means of the force of the movement of the trigger transferred rearward through the sear, is terminated by virtue of the release of the engagement of the sear end and the recess end.

The dominant force is now exerted by the strut spring 75 acting against the yoke 73 to force the strut seat 71 against the pin 61. The latter force thrusts the hammer in a forward pivoting direction to a striking position resulting in one of the firing pins 104 being struck by the forward thrust of the previously aligned firing lug 91 thereby firing one of the cartridges. The hammer is free to return to the at-rest position as shown in FIG. 2.

A machine-gunning effect is prevented by a disabling means or lug 35 which projects outwardly from the side of the rear end of the upper segment 21 of the trigger. The lug prevents the pawl or hand 80 from returning to a position so as to engage a lower notch 94 while the trigger is in a "fired" position; therefore, the ratchet 90 and hence firing lug 91 secured in position by the ratchet plunger 99 cannot be further rotated to align and contact another firing pin until the trigger is moved to its at-rest position and pulled a second time.

The barrel assembly 12 may be opened by pivoting the barrel assembly on the barrel pivot pin 130. The opening of the barrel assembly causes the extractor guide and hence the extractor 120 to move relative to the barrels 15, thus forcing the ends of the spent cartridges from the barrel.

It will thus be seen that the objects set forth above among those made apparent from the preceding description are efficiently obtained, and since certain changes may be made in the above construction without departing from the spirit and scope of the invention, it is intended that all matter contained in the above description or shown in the accompanying drawings shall be interpreted as illustrative and not in a limiting sense.

I claim:

1. A handgun comprising a frame, a barrel assembly supported on said frame and including a plurality of barrels, each of said barrels having an associated cartridge chamber, a trigger supported on said frame for movement between ready and firing positions, a hammer pivotally supported on said frame for movement between releasing and striking positions, a firing element supported on said hammer for rotary indexing movement in one direction relative to said hammer to successive striking locations, said firing element in each of its striking locations being aligned with an associated one of said cartridge chambers, indexing means for rotating said firing element to one of its striking locations in response to movement of said hammer to its releasing position, means for biasing said indexing means in the direction of said striking position and toward engagement with said firing element, detent means for accurately aligning and releasably retaining said firing element in said one striking location and preventing retrograde rotation of said firing element from said one striking location, strut means for biasing said hammer from its releasing position toward its striking position and including a strut engageable with said hammer and a strut spring acting between said strut in said frame, sear means for moving said hammer to its releasing position in opposition to the biasing force of said strut means and releasing it in its releasing position in response to movement of said trigger from its ready position to its firing position, and stop means for arresting movement of said strut in the direction of said striking position, said strut means being out of engagement with said hammer during the initial portion of the travel of said hammer toward its releasing position in response to movement of said trigger from its ready position toward its firing position and during the final portion of the travel of the hammer from its releasing position to its striking position, said means for biasing said indexing means acting through said indexing means and said firing element and biasing said hammer toward its striking position when said trigger is in its ready position and during initial movement of said hammer toward its releasing position in response to movement of said trigger toward its firing position.

2. A handgun as set forth in claim 1 including means for disabling said indexing means while said trigger is in its firing position.

3. A handgun as set forth in claim 2 wherein said indexing means comprises a plurality of notches in said firing element and a pawl engageable with said notches and said disabling means comprises means on said trigger for engaging said pawl.

4. A handgun as set forth in claim 1 wherein said detent means comprises a ball detent mechanism carried by said hammer.

5. A handgun comprising a frame, a barrel assembly supported on said frame and including a plurality of barrels, each of said barrels having an associated cartridge chamber, a trigger supported on said frame for movement between ready and firing positions, a hammer pivotally supported on said frame for movement between releasing and striking positions, a firing element supported on said hammer for rotary indexing movement relative to said hammer to successive striking locations, detent means carried by said hammer and cooperating with said firing element for accurately aligning and releasably retaining said firing element in each of its striking locations, said firing element in each of its striking locations being aligned with an associated one of said cartridge chambers, indexing means for rotating said firing element to one of its striking locations in response to movement of said hammer to its releasing position, means for biasing said indexing means in the direction of said striking position and toward engagement with said firing element, strut means for biasing said hammer from its releasing position toward its striking position and including a strut engageable with said hammer and a strut spring acting between said strut in said frame, sear means for moving said hammer to its releasing position in opposition to the biasing force of said strut means and releasing it in its releasing position in response to movement of said trigger from its ready position to its firing position, stop means for arresting movement of said strut in the direction of said striking position, said strut means being out of engagement with said hammer during the initial portion of the travel of said hammer toward its releasing position in response to movement of said trigger from its ready position toward its firing position and during the final portion of the travel of the hammer from its releasing position to its striking position, and means for disabling said indexing means while said trigger is in its firing position and during at least a portion of the movement of the trigger from its firing to its ready position.

6. A handgun as set forth in either claim 1 or claim 5 wherein the means supporting said hammer comprises said stop means.

7. A handgun as set forth in claim 6 wherein said means supporting said hammer comprises a pivot pin.

8. A handgun as set forth in claim 7 wherein said strut is engageable with said hammer in radially spaced relation to the pivotal axis of said hammer.

9. A handgun as set forth in claim 8 wherein said strut has a yoke defining a first point of contact engageable with said hammer and a second point of contact engageable with the means supporting said hammer.

10. A handgun as set forth in claim 9 wherein said firing mechanism includes another pin mounted on said hammer in radially spaced relation to the pivotal axis of said hammer and said first point of contact is engageable with said other pin.

11. A handgun as set forth in claim 9 wherein said strut comprises a generally T-shaped member having a crossbar portion and a stem portion.

12. A handgun as set forth in claim 11 wherein said yoke is defined by said crossbar portion and said strut spring is received on said stem portion.

13. A handgun comprising a frame, a barrel assembly supported on said frame and including a plurality of barrels, each of said barrels having an associated cartridge chamber, a trigger supported on said frame for movement between ready and firing positions, a hammer pivotally supported on said frame for movement between releasing and striking positions, a firing element supported on said hammer for rotary indexing movement relative to said hammer to successive striking locations, said firing element in each of its striking locations being aligned with an associated one of said cartridge chambers, indexing means for rotating said firing element to one of its striking locations in response to movement of said hammer to its releasing position and including a plurality of outwardly opening notches equal in number to said striking locations and formed in said firing element and a pawl engageable with an associated one of said notches when said firing element is at one of said firing locations, detent means for accurately aligning and releasably retaining said firing element in said one striking location and including a detent member engageable with another of said notches when said firing element is at said one firing location, means for biasing said indexing means in the direction of said striking position and toward engagement with said firing element, strut means for biasing said hammer from its releasing position toward its striking position and including a strut engageable with said hammer and a strut spring acting between said strut in said frame, sear means for moving said hammer to its releasing position in opposition to the biasing force of said strut means and releasing it in its releasing position in response to movement of said trigger from its ready position to its firing position, and stop means for arresting movement of said strut in the direction of said striking position, said strut means being out of engagement with said hammer during the initial portion of the travel of said hammer toward its releasing position in response to movement of said trigger from its ready position toward its firing position and during the final portion of the travel of the hammer from its releasing position to its striking position, said means for biasing said indexing means acting through said indexing means and said firing element and biasing said hammer toward its striking position when said trigger is in its ready position and during initial movement of said hammer toward its releasing position in response to movement of said trigger toward its firing position.

14. A handgun as set forth in claim 13 wherein each of said notches is at least partially defined by a first surface generally parallel to the axis of said firing element and a second surface inclined outwardly and away from said first surface.

15. A handgun as set forth in claim 14 wherein said first surface is disposed in an axial plane.

16. A handgun comprising a frame, a barrel assembly supported on said frame and including a plurality of barrels, each of said barrels having an associated cartridge chamber, a trigger supported on said frame for movement between ready and firing positions, a hammer pivotally supported on said frame for movement between releasing and striking positions, a firing element supported on said hammer for rotary indexing movement relative to said hammer to successive striking locations, said firing element in each of its striking locations being aligned with an associated one of said cartridge chambers, indexing means for rotating said firing element to one of its striking locations in response to movement of said hammer to its releasing position, means for biasing said indexing means in the direction of said striking position and toward engagement with said firing element, strut means for biasing said hammer from its releasing position toward its striking position and including a strut engageable with said hammer and a strut spring acting between said strut in said frame, sear means for moving said hammer to its releasing position in opposition to the biasing force of said strut means and releasing it in its releasing position in response to movement of said trigger from its ready position to its firing position, means for disabling said indexing means while said trigger is in its firing position, and stop means for arresting movement of said strut in the direction of said striking position, said strut means being out of engagement with said hammer during the initial portion of the travel of said hammer toward its releasing position in response to movement of said trigger from its ready position toward its firing position and during the final portion of the travel of the hammer from its releasing position to its striking position, said means for biasing said indexing means acting through said indexing means and said firing element and biasing said hammer toward its striking position when said trigger is in its ready position and during initial movement of said hammer toward its releasing position in response to movement of said trigger toward its firing position.

17. A handgun as set forth in claim 16 wherein said disabling means comprises a lug projecting from said trigger.

18. A handgun as set forth in claim 16 wherein said disabling means further comprises means for maintaining said indexing means in a disabled condition during at least a portion of the movement of the trigger from its firing to its ready position.

* * * * *